US010368671B2

(12) United States Patent
Berg

(10) Patent No.: US 10,368,671 B2
(45) Date of Patent: Aug. 6, 2019

(54) GYROSCOPIC CUP HOLDER

(71) Applicant: Donald Joseph Berg, Escondido, CA (US)

(72) Inventor: Donald Joseph Berg, Escondido, CA (US)

( * ) Notice: Subject to any disclaimer, the term of this patent is extended or adjusted under 35 U.S.C. 154(b) by 0 days.

(21) Appl. No.: 15/492,229

(22) Filed: Apr. 20, 2017

(65) Prior Publication Data

US 2018/0092481 A1 Apr. 5, 2018

Related U.S. Application Data

(62) Division of application No. 14/852,309, filed on Sep. 11, 2015, now abandoned.

(51) Int. Cl.

| | |
|---|---|
| ***A45F 5/00*** | (2006.01) |
| ***A47G 23/02*** | (2006.01) |
| ***A45C 13/28*** | (2006.01) |
| ***A45C 13/26*** | (2006.01) |

(52) U.S. Cl.

CPC ..... *A47G 23/0225* (2013.01); *A45C 13/262* (2013.01); *A45C 13/28* (2013.01); *A45F 5/00* (2013.01); *A45F 2200/0583* (2013.01); *A47G 2400/086* (2013.01)

(58) Field of Classification Search

CPC ..... A47G 23/0225; A47G 2400/086; A45C 13/262; A45C 13/28; A45C 2013/306; A45C 13/30; A45F 5/00; A45F 2200/0583

USPC ..... 248/313, 311.2

See application file for complete search history.

(56) References Cited

U.S. PATENT DOCUMENTS 2,926,879 A * 3/1960 Dietrich ..... A47G 23/0225 224/406
3,842,981 A * 10/1974 Lambert ..... A47G 29/08 211/74
3,913,187 A * 10/1975 Okuda ..... F16L 3/1075 24/16 PB
4,183,120 A * 1/1980 Thorne ..... B25B 25/005 24/16 R
4,819,843 A * 4/1989 Nakayama ..... B60N 3/103 108/44
4,826,058 A * 5/1989 Nakayama ..... B60N 3/102 224/275

(Continued)

*Primary Examiner* — Anita M King

(57) ABSTRACT

Attachment mechanisms that enhance and broaden the usefulness of a basic gimbaled beverage container holder are needed. The mechanisms developed are configured to form a rigid attachment to an external object, such as luggage handles; stroller handles; bicycle handles; boat railings; car/truck air vents etc. in order to give the user a sense of stability for the combined unit. Three basic attachment enhancements are added to the outer ring of the gimbaled cup holder. They are: 1) A set of rigid 'Arms' (*removable and exchangeable for different size luggage handles) that grab around vertical luggage handles and hold the gimbaled cup holder secure. 2) a 'Slide' mechanism on one of the handles that hold the gimbaled cup holder secure to one handled luggage. 3) A 'T-Bar Clip' on the outer ring of the gimbaled cup holder that securely locks a variety of attachment devices (*such as a vertical and horizontal bar attachment mechanisms; a car/truck air vent attachment mechanism, etc.,) to most external objects or transport devices.

3 Claims, 7 Drawing Sheets

(56) References Cited

U.S. PATENT DOCUMENTS

| | | | | | |
|---|---|---|---|---|---|
| 4,972,982 | A * | 11/1990 | Harbour | A45F 5/00 | 224/148.4 |
| 5,024,405 | A * | 6/1991 | McGuire | F16B 7/0493 | 24/16 PB |
| 5,390,887 | A * | 2/1995 | Campbell | B60N 3/103 | 224/42.32 |
| 5,464,183 | A * | 11/1995 | McConnell | B62B 9/26 | 224/274 |
| 5,961,083 | A * | 10/1999 | Hartmann | B60N 3/101 | 248/222.14 |
| 6,186,454 | B1 * | 2/2001 | Olsen | G09F 7/18 | 248/218.4 |
| 6,837,472 | B1 * | 1/2005 | Beutz | A45F 3/16 | 224/148.4 |
| 8,235,190 | B2 * | 8/2012 | Porte | A45C 5/14 | 190/100 |
| 8,827,216 | B2 * | 9/2014 | Brown | B25H 1/0021 | 248/124.1 |
| 2009/0078714 | A1 * | 3/2009 | Peacock | A47G 23/0216 | 220/710.5 |

* cited by examiner

GYROSCOPIC CUP HOLDER

RELATED APPLICATION

This application claims relation to provisional patent application U.S. Ser. No. 62/052,290 filed on Sep. 18, 2014.

BACKGROUND

The embodiments herein relate generally to travel accessories, and more particularly, to a gimbaled cup holder configured to attached to various items, such as handles on luggage, tray tables on planes, horizontal handles (*e.g. bicycles, strollers, carts, boat railings), and air vents in vehicles such as cars and trucks.

For travelers, balancing luggage, a snack, personal items, and a drink can be difficult, often resulting in spilling of beverages either while walking around or while seated on, for example, a plane or in a car. There are some cup holders that exist that attach to luggage. However, these conventional cup holders are not adapted to many types of luggage and moving vehicles, and many do not contain two axes gimbals. They do not contain a 'rigid' set of attachment arms, or a 'T-Slot' mechanism to hold the gimbal mechanism secure, and thus give the user a sense of stability for his/her drink holder.

Therefore, what is needed is a cup holder that can easily attach to luggage or a moving vehicle, while simultaneously accommodating various mechanisms to attach to most moving vehicles. The gimbal mechanism then preventing or reducing the likelihood that a liquid stored within the beverage container will spill.

SUMMARY

Some embodiments of the present disclosure include a gimbaled cup holder (*covered by previous art and patents) configured to hold and stabilize a beverage container, the cup holder being configured to attach to an external object. The gimbaled cup holder may include several mechanisms to attach the outer ring of the gimbaled stabilization device. For example, the outer ring may include a set of 'arms' extending from the outer ring and 'clasping together 'like hands', or a 'slide' on one arm to lock in a single handle, or an outer ring clip extending from the external surface of the outer ring, having a T-shaped tab configured to engage with a variety of removable and interchangeable securing attachments.

BRIEF DESCRIPTION OF THE FIGURES

The detailed description of some embodiments of the invention are made below with reference to the accompanying figures, wherein like numerals represent corresponding parts of the figures.

FIG. 17 is a section detail view of one embodiment of the present disclosure showing the 'Universal T-Bar Attachment Clip' with a 'Vertical Bar Attachment Device', taken along line 17-17 in FIG. 16.

FIG. 18A is a perspective view, rotated along one axis, of the 'Single Handle Slide Clip' attached to the 'Multiple Hook Arm' on the Outer Ring of the present disclosure.

FIG. 18B is a top view of the 'Single Handle Slide Clip' attached to the 'Multiple Hook Arm' on the Outer Ring of the present disclosure taken along line 18B-18B in FIG. 18A.

FIG. 19 is a perspective detail view of an ABANDONED embodiment of the present disclosure.

FIG. 20 is a section detail view of an ABANDONED embodiment of the present disclosure, taken along line 20-20 in FIG. 18.

DETAILED DESCRIPTION OF CERTAIN EMBODIMENTS

Figure 1:
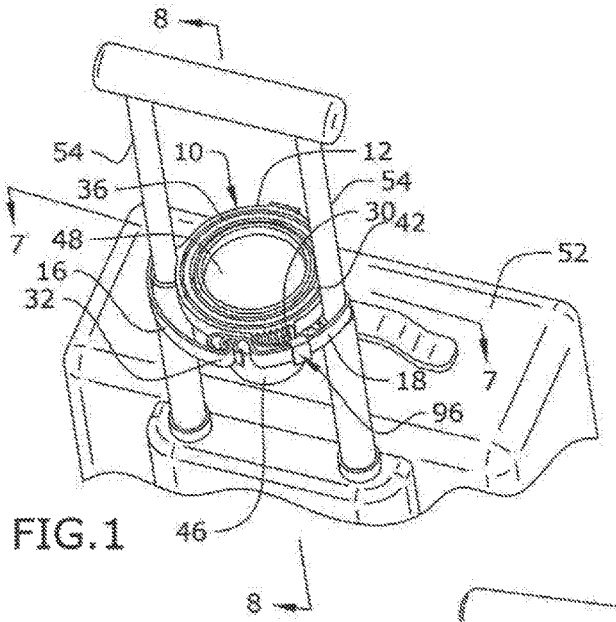
FIG. 1 is a perspective view of all embodiment of the present disclosure.
Figure 2:
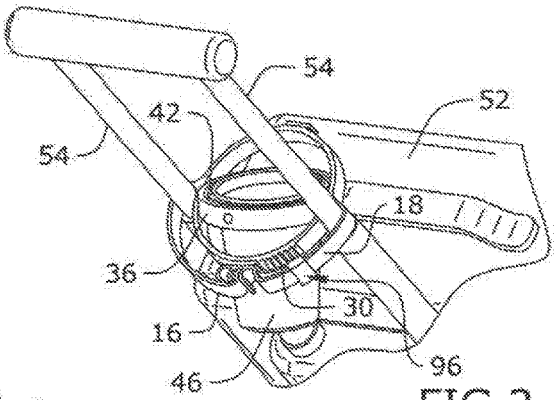
FIG. 2 is a perspective view of all embodiment of the present disclosure.
Figure 3:
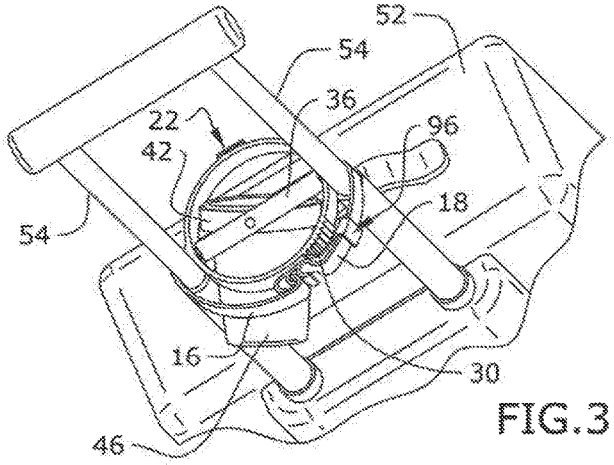
FIG. 3 is a perspective view of all embodiment of the present disclosure.
Figure 4:
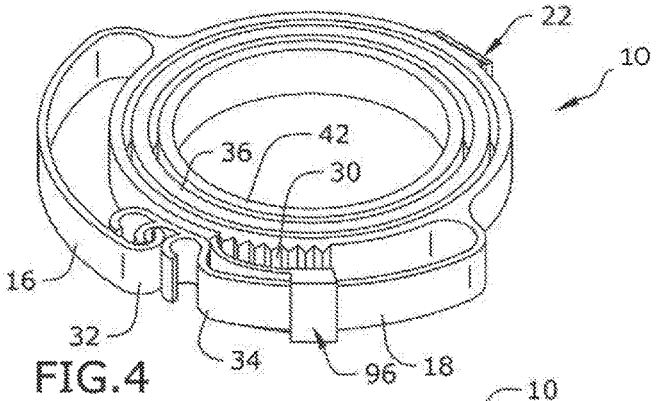
FIG. 4 is a perspective view of all embodiment of the present disclosure.
Figure 5A:
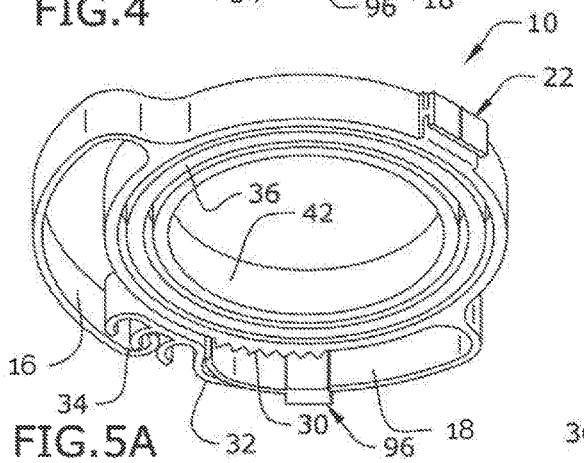
FIG. 5A is a bottom perspective view of all embodiment of the present disclosure.
Figure 5B:
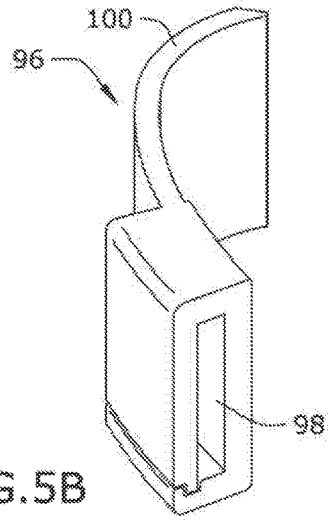
FIG. 5B is a perspective view of the 'One-Arm Slide' of the present disclosure.
Figure 6:
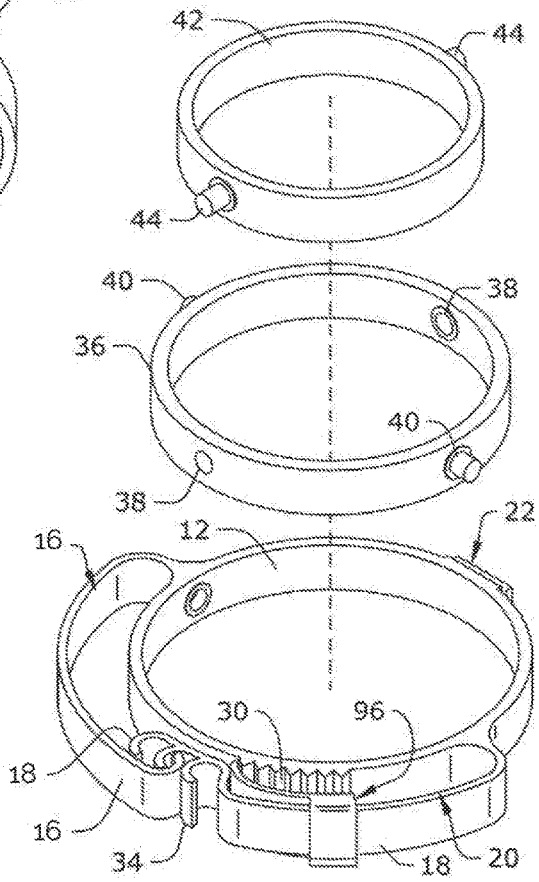
FIG. 6 is an exploded view of all embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to hold a beverage container and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. The 2 axes gimbaled cup holder device is already covered by previous art and patents.
2. A variety of new and stable attachment devices for the gimbaled cup holder.
3. They include, but are not limited to, a set of rigid arms that are part of the outer gimbal ring with 'hooks' that clasp them tight to the handles when clasped like curled fingers; a 'Slide' that slides on one of the aforementioned arms and locks a single vertical handle in place; and a 'Universal T-Bar Clip' that allows a variety of attachment devices to hook onto the outer ring of the gimbaled mechanism.

The various elements of the gimbaled cub holder for holding a beverage of the present disclosure may be related in the following exemplary fashion. It is not intended to limit the scope or nature of the relationships between the various elements and the following examples are presented as illustrative examples only.

By way of example, and referring to FIGS. 1-20, some embodiments of the gimbaled cup holder 10 of the present disclosure comprise an attachment device extending from an external surface the outer ring 12, the attachment device configured to attach the cup holder 10 to an external object, such as a piece of luggage, a tray table, a vent in a vehicle, or any other desired surface. For example, as shown in the Figures, the attachment device may comprise a device configured to secure the cup holder 10 to a pair of handles 54 that upwardly extend from a piece of luggage 52. The device may comprise an outer ring arm extending from the outer ring 12, wherein the outer ring arm comprises an outer ring single hook arm 16 and an outer ring multi hook arm 18 configured to engage with one another, wherein each of the outer ring single hook arm 16 and the outer ring multi hook arm 18 comprise a gripping gap region 20 configured to accommodate and grip the handles 54, securing the cup holder 10 to the luggage 52.

Figure 7:
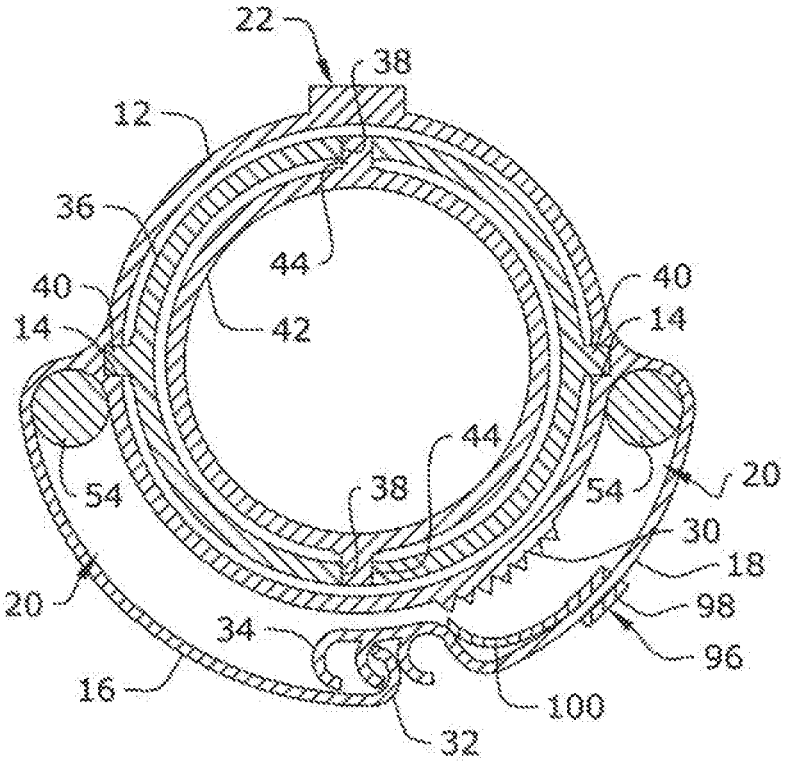
FIG. 7 is a section detail view of all embodiment of the present disclosure, taken along line 7-7 in FIG. 1.
Figure 8:
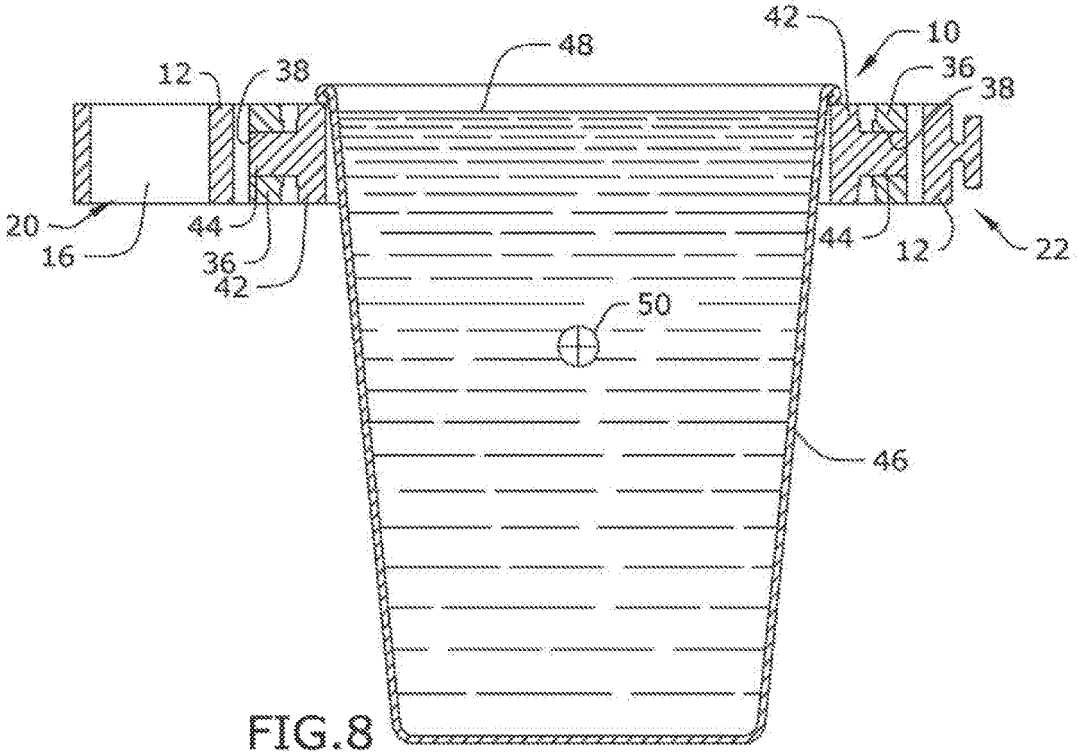
FIG. 8 is a side section detail view of all embodiment of the present disclosure, taken along line 8-8 in FIG. 1 including drink and how c.g. keeps drink upright.

As shown, for example, in FIG. 7, the outer ring single hook arm 16 may have a single hook 32 positioned at an end of the outer ring single hook arm 16 distal from the handle 54, wherein the single hook 32 may curve inwards toward the outer ring 12. The outer ring multi hook arm 18 may have a plurality of hooks 34 at an end of the outer ring multi hook arm 18 distal from the handle 54, wherein the hooks 34 may curve outwards away from the outer ring 12. The single hook 32 may be configured to engage with one of the hooks 34 to close the outer ring arm around the handles 54. Which hook 34 the single hook 32 engages with may depend on the width of the handles 54. Thus, the size of the outer ring arm may be adjustable, as needed.

As shown in the Figures, extending outwardly from the outer ring 12 proximate to the outer ring multi hook arm 18 may be a plurality of teeth 30. A one-handle clip 96 may be attached to the outer ring multi hook arm 18, wherein the one-handle clip 96 comprises a sleeve 98 that wraps around the outer ring multi hook arm 18 and a clip arm 100 that extends from the sleeve 98 towards the teeth 30. The clip arm 100 may be configured to curve inwards toward the outer ring 12 to engage with the teeth 30 to help secure the cup holder 10 in place during use.

Although cup holder systems using straps to secure cup holder to upright objects, and are covered by previous art and Patents (*i.e. Harbour (gimbaled container holder with strapping system for attachment to a person (U.S. Pat. No. 4,972,98)), and a non-gimbaled strapping system to attachment to upright luggage handles Patent (*i.e. Porte et al (U.S. Pat. No. 8,235,190 B2)) some embodiments include rigid attachment mechanisms to the outer ring.

Although the gimbaled cup holder system is covered by previous art and Patents (*i.e. Peacock (Hand held gimbaled system) Patent Number US 2009/0078714 A1)), some embodiments include (*not shown) removable rigid arms for different width handles.

In some embodiments, the inner ring 42 may be sized to accommodate a specific beverage container 46. However, in the case where the container 46 is too large to fit within the inner ring 42, the inner ring 42 may be removed and the container 46 may be accommodated within the middle ring 36. While this results in a greater number of containers 46 being able to be held by the cup holder 10, removing the inner ring 42 does remove an axis of rotation. Additionally, in some embodiments, the inner ring 42 may comprise a netting (not shown) extending downwardly therefrom, wherein the netting may help prevent a container 46 from falling through the cup holder 10.

In addition to or as an alternative to the outer ring arm, the cup holder 10 may comprise a variety of additional (or alternative) devices to secure the cup holder 10 to another object.

Figure 9:
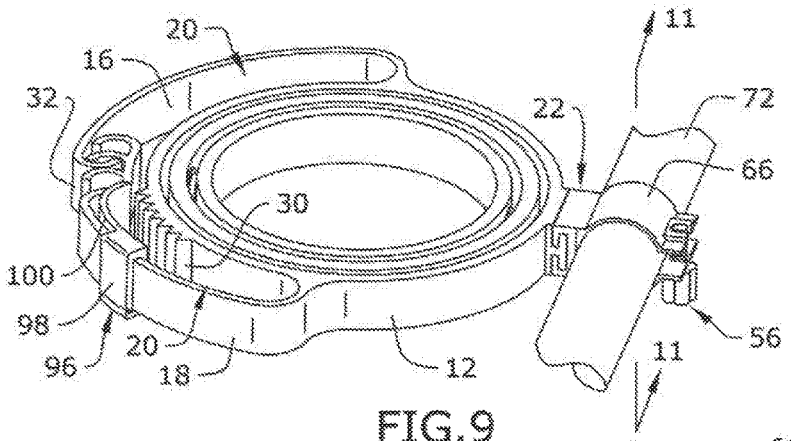
FIG. 9 is a perspective view of one embodiment of the present disclosure showing the 'Universal T-Bar Attachment Clip' with a 'Horizontal Bar Attachment Device'.
Figure 10:
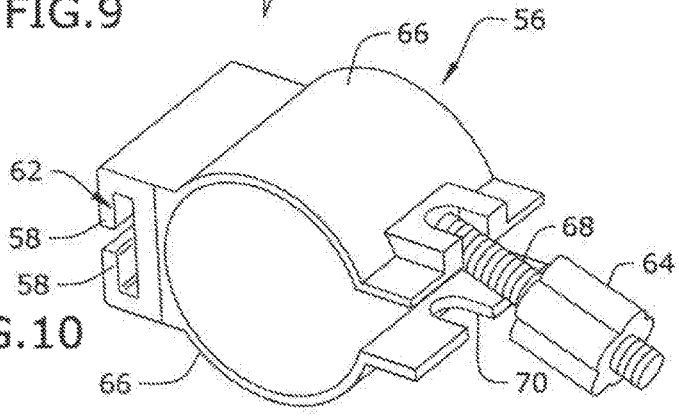
FIG. 10 is perspective view of a 'Horizontal Bar Attachment Device'.
Figure 11:
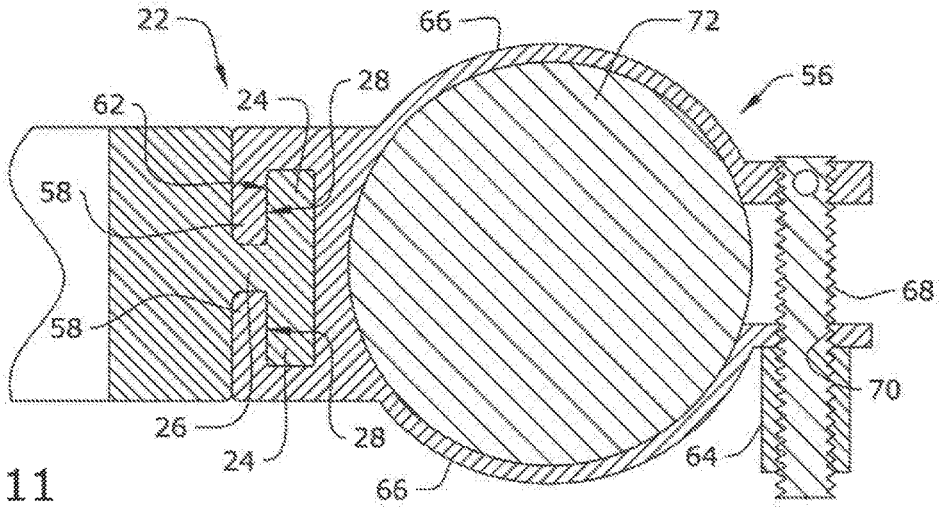
FIG. 11 is a side detail perspective view of a 'Horizontal Bar Attachment Device' taken along line 11-11 in FIG. 9.

Moreover, the cup holder 10 may further comprise an outer ring clip 22 configured to engage with securing attachments, wherein the securing attachments may be used to secure the cup holder 10 to another object. The securing attachments may be removable and interchangeable, depending on the desired use by the user. In some embodiments, the outer ring clip 22 may comprise a T-shaped tab comprising a vertical arm 24 extending from a horizontal arm 26, wherein a vertical slot 28 is formed between the T-shaped tab and the outer ring 12, the T-shaped tab being configured to engage with the securing attachments. For example, as shown in FIG. 9, the outer ring clip 22 may be designed to engage with a horizontal bar clip 56, wherein the horizontal bar clip 56 comprises a T-slot 62 defined by a pair of horizontal clip arms 58 that are configured to engage with the vertical slots 28, such that the T-shaped tab may be accommodated within the Tslot 62. The horizontal bar clip 56 may be configured to engage with a horizontal bar 72, such as a bicycle handlebar or a stroller handlebar. As shown in FIG. 10, the horizontal bar clip 56 may comprise a clip ring arm 66 configured to at least partially encircle or envelope a horizontal bar 72, wherein the clip ring arm 66 may be secured around the horizontal bar 72 using any suitable fastener, such as a threaded rod 68 configured to extend through a slot 70 in the clip ring arm 66, wherein the threaded rod 68 is secured in place with a securement knob 64, such as a nut.

Figure 12A:
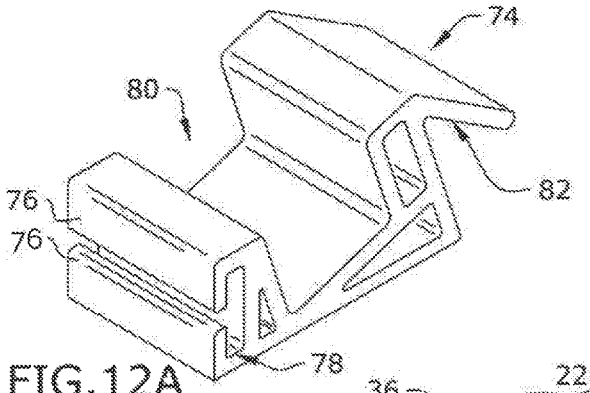
FIG. 12A is a perspective view of one version of a 'Tray Table Clip' that attaches to the 'Universal T-Bar Attachment Clip' on this embodiment of the present disclosure.
Figure 12B:
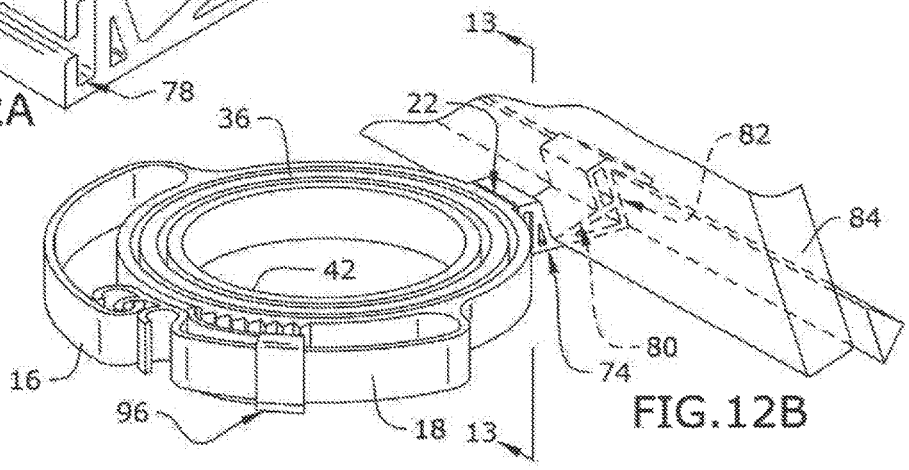
FIG. 12B is a perspective view of the entire assembly of the 'Tray Table Clip' that attaches to the 'Universal T-Bar Attachment Clip' on an airline upright tray table.
Figure 13:
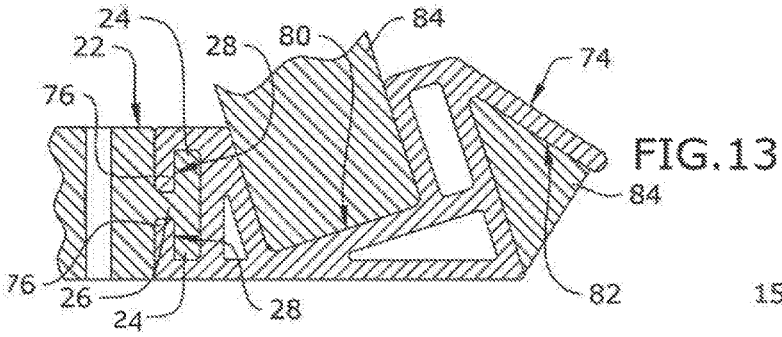
FIG. 13 is aside perspective view of one version of a 'Tray Table Clip' that attaches to the 'Universal T-Bar Attachment Clip' on this embodiment of the present disclosure.
Figure 14:
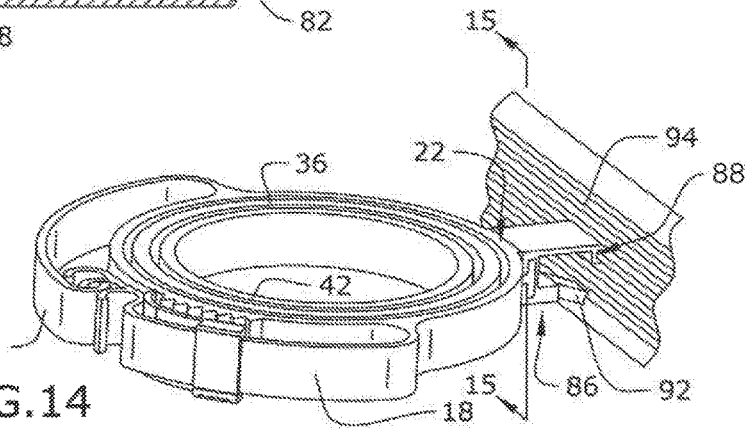
FIG. 14 is a is a perspective view of the entire assembly of the 'Car Vent Clip' that attaches to the 'Universal T-Bar Attachment Clip' in a car or truck.
Figure 15:
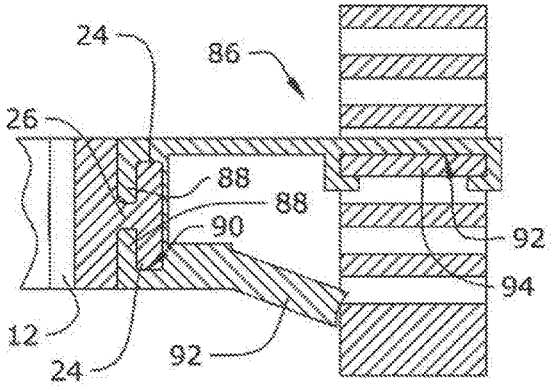
FIG. 15 is a side perspective view of the 'Car Vent Clip' that attaches to the 'Universal T-Bar Attachment Clip' in a car or truck, taken along line 15-15 in FIG. 14.
Figure 16:
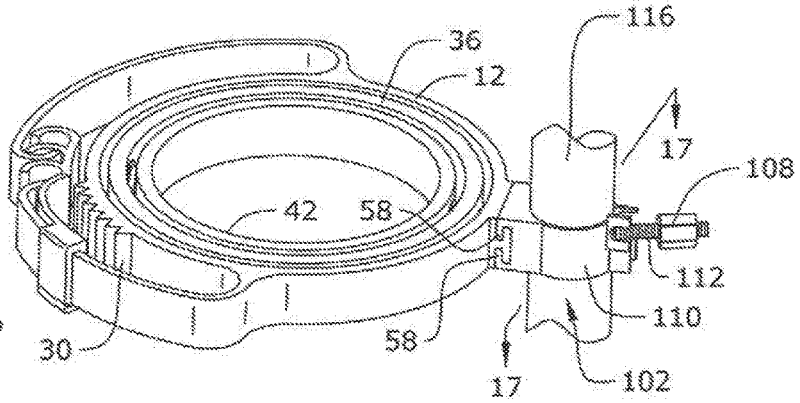
FIG. 16 is a perspective view of one embodiment of the present disclosure showing the 'Universal T-Bar Attachment Clip' with a 'Vertical Bar Attachment Device'.

Other securing attachments may also be used in conjunction with the outer ring clip 22. For example, the securing attachment may comprise a tray table clip 74, as shown in FIGS. 12A, 12B, and 14, a vent clip 86, as shown in FIGS. 14 and 15, a vertical bar clip 102, as shown in FIGS. 16 and 17, a combination vertical/horizontal bar clip (not shown), or the like. In fact, any securing attachment is envisioned for securing the cup holder 10 to any desired object.

In the case of the tray table clip 74, the tray table clip 74 may comprise a pair of vertical clipping arms 76 and a horizontal clipping T-slot 78 configured to engage with the Tshaped tab on the outer ring clip 22. The tray table clip 74 may also comprise a major slot 80 and an angled minor slot 82, wherein the major slot 80 may be configured to accommodate an edge of a tray table 84, and the minor slot 82 may extend downwardly away from the tray table 84, such that the minor slot 82 can engage with, for example, a pocket on the back of an airplane seat, as shown in FIG. 12B.

When used, the vent clip 86 may also comprise a vent clip T-slot 90 defined by a pair of vent clip vertical clipping arms 88, wherein the vent clip T-slot 90 is configured to engage with the T-tab on the outer ring clip 22. The vent clip 86 may comprise a pair of support arms 92 extending outwardly away from the outer ring clip 22, wherein an upper support arm comprises a structure configured to secure to a vent bar 94 in an air vent, such as an automobile's air vent, as shown in FIG. 15, and a lower support arm comprises a structure configured to prevent the cup holder 10 from sagging downwards while in use.

The vertical bar clip 102 may be similar in structure to the horizontal bar clip 56, but oriented in a way to accommodate a vertical bar 116. For example, as shown in FIGS. 16 and 17, the vertical bar clip 102 may comprise a T-slot defined by a pair of vertical bar clip arms that are configured to engage with the vertical slots 28, such that the T-shaped tab may be accommodated within the T-slot 62. As shown in FIG. 17, the vertical bar clip 102 may comprise a clip ring arm 110 configured to at least partially encircle or envelope a vertical bar 116, wherein the clip ring arm 110 may be secured around the vertical bar 116 using any suitable fastener, such as a pivoting threaded rod 112 that is secured in place with a securement knob 108, such as a nut. In an alternate embodiments, the securing attachment may comprise a bar clip that can be rotated to function as either a horizontal bar clip or a vertical bar clip.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A two-axes gimbaled cup holder for holding and stabilizing a beverage container, reducing the likelihood of a liquid being spilled out of the beverage container, and configured to attach a large variety of external objects, the cup holder comprising:

an outer ring, an inner ring, and a middle ring, wherein the rings are pivotally attached to each other via pivot pins and pin orifices, respectively;

a set of mechanisms for enhancing attachment capabilities of the cup holder, including:

a pair of arms protruding from the outer ring, that clasp together and hold the mechanism tightly to any upright structures of the external object and wherein the arms are adjustable to different lengths to accommodate different upright structure widths;

a slide mechanism on one of the pair of arms for pressing against a side of the upright structure of the external object to rigidly secure the cup holder to the upright structure; and an attachment device including a universal T-bar clip protruding form a back side of the outer ring, which forms a base mechanism for easily attaching and detaching a wide variety of removable and interchangeable securing attachments having a T-slot.

2. The cup holder of claim 1, wherein one of the pair of arms is a single hook arm having a single hook positioned at a distal end thereof, the single hook curving inwards towards the outer ring and the other of the pair of arms is a multi-hook arm having a plurality of hooks at a distal end thereof, each of the plurality of hooks curving outwards away from the outer ring, and wherein the single hook is configured to engage with at least one of the plurality of hooks in a clasping manner to close the pair of arms around the upright structures and secure the cup holder to the upright structures of the external object.

3. The cup holder of claim 1, wherein the T-bar clip comprises a T-shaped tab configured to engage with the removable and interchangeable securing attachments, wherein the securing attachments are selected from the group consisting of a horizontal bar clip, a vertical clip, a combination horizontal/vertical bar clip, and a vent clip.

* * * * *